US005489230A

United States Patent [19]

Gavula, Jr.

[11] Patent Number: 5,489,230

[45] Date of Patent: Feb. 6, 1996

[54] BLANK FOR CONSTRUCTING TRIANGULAR POLYHEDRA

[76] Inventor: John Gavula, Jr., 401 William St., River Forest, Ill. 60305-1900

[21] Appl. No.: 376,775

[22] Filed: Jan. 23, 1995

[51] Int. Cl.[6] ..... A63H 33/08

[52] U.S. Cl. ..... 446/109; 446/124; 428/33; 428/542.8; 434/403

[58] Field of Search ..... 446/109, 85, 488, 446/120, 121; 434/211, 403; 428/33, 542.8, 9, 11, 12

[56] References Cited

U.S. PATENT DOCUMENTS 2,787,073 4/1957 Woolven ..... 446/109 X 3,461,574 8/1969 Larsen et al. ..... 434/403

3,611,617 10/1971 Foster et al. ..... 446/488 X 3,666,607 5/1972 Weissman ..... 428/33

*Primary Examiner*—Mickey Yu

[57] ABSTRACT

A geometric construction set is described having a number of blanks where each blank includes four contiguous triangular sections. The two outer triangular sections each have two edges at the peripheral edge of the blank and the remaining two inner triangular sections having only one edge at the peripheral edge of the blank. Each outer triangular section has a connector that is mateable with a connector on each of the inner triangular sections. The blanks are designed to facially interconnect with other matching blanks allowing the construction of a large variety of triangular polyhedra.

21 Claims, 7 Drawing Sheets

BLANK FOR CONSTRUCTING TRIANGULAR POLYHEDRA

TECHNICAL FIELD

This invention relates to geometric construction toys and more particularly to a construction set having a number of blanks where each blank includes four contiguous triangular sections, the blanks being capable of interconnection allowing the formation of many and varied triangular polyhedra.

BACKGROUND OF THE INVENTION

Various systematic methods and means are encountered in the prior art for construction of geometric polyhedral solids. One example is shown in Stallman, U.S. Pat. No. 5,205,556 issued Apr. 27, 1993. The object of the Stallman design is to provide a specific geodesic dome design. The specificity of the Stallman design limits the number of constructible configurations. The design also has limited structural stability since each sub-unit of the polyhedron is split down one of the triangular faces so that a vertex can be formed from an initially flat blank. Also, the fastening mechanism is structurally weak, susceptible to separation when tension is applied across two vertices.

Another form of construction set with modular elements is described in Ziegler, U.S. Pat. No. 4,874,341 issued Oct. 17, 1989. The object of the Ziegler design is to provide a polygonal construction toy capable of being assembled into a wide variety of structural shapes. The Ziegler design requires a rigid material and close tolerances to achieve a snap together interlock between adjacent edges or faces. A further disadvantage is that image-bearing surfaces are difficult to manufacture with this design.

A blank for constructing solid forms is described in Weissman, U.S. Pat. No. 3,666,607 issued May 30, 1972. The object of the Weissman design is to provide a polygonal construction toy using a stiff planar sheet that can be assembled into a variety of geometric solids. One disadvantage of the Weissman design is that the connective mechanism is accomplished at the edges of the polygonal sections through the use of tabs and slots which require extensive detail in the design of the apparatus used to cut or form the blanks. Further, the strength of the edge connection is limited by the frictional forces between the tab and slot. Another disadvantage is that Weissman only uses regular polygonal shapes, meaning that all edge lengths and angles are equal, which limits the variety of constructible configurations.

SUMMARY OF THE INVENTION

In accordance with the present invention, the disadvantages of prior construction systems have been overcome. The construction set of the present invention includes a number of blanks. Each blank includes four contiguous triangular sections each of which is connectable with a triangular section of another blank so that a number of blanks can be connected to construct any type of triangular polyhedron.

A blank of the present invention includes a planar sheet of a semi-rigid material, the sheet being divided into four triangular sections by three score lines along which the sheet is bendable or foldable. The sections include two outer triangular sections and two inner triangular sections. Each inner triangular section has a first side formed on a score line in common with an outer triangular section; a second side formed on a score line in common with the other inner triangular section; and a third side on a peripheral edge of the blank. Each of the outer triangular sections has two sides on a respective peripheral edge of the blank.

In accordance with one embodiment of the present invention each of the four triangular sections is an isosceles triangle. Two or more of the sections on a given blank may be similar. Alternatively all of the triangular sections on a given blank may be different. However in this latter embodiment, an outer triangular section of one blank of a set always matches, i.e. it is of the same size and shape, as an inner triangular section of a different blank of the same set.

The blanks forming the construction set of the present invention have numerous advantages. For example when two blanks are connected together they have overlapping faces so as to increase the structural stability of the resulting three dimensional shape. The blanks are easy to manufacture cheaply. Each blank has an image bearing surface that allows the resulting polyhedra to be colorful, decorative or pictorial. The blanks are easily assembled, disassembled, and reassembled to form a variety of polyhedral configurations. The blanks can be used to form a game or puzzle the object of which is to assemble a specific three dimensional polyhedron.

Further objects and advantages are to provide a construction set which can be used easily by children, which allows creative expression through the use of polyhedral solid shapes, and which provides an educational demonstration of the inherent stability of triangular polyhedral shapes. Still further objects and advantages of the invention will become apparent from a consideration of the drawings and ensuing description.

BRIEF DESCRIPTION OF THE DRAWING

In the drawings, closely related figures have the same number but different alphabetic suffixes.

DESCRIPTION OF THE PREFERRED EMBODIMENT

Reference is made to the drawings for a description of the preferred embodiment of the present invention wherein like reference numbers represent like elements of corresponding views.

The present invention is a design for blanks which can be assembled into polyhedra comprising facially overlapping and facially interlocking triangles. Each of the blanks is made of a thin semi-rigid material which can be bent along predetermined lines and defined by a plurality of possible geometric configurations. Each configuration in turn comprises four triangular sections of a plurality of sizes and/or shapes designed to overlap and interlock with a matching triangular section on an adjoining blank.

Figure 1A:
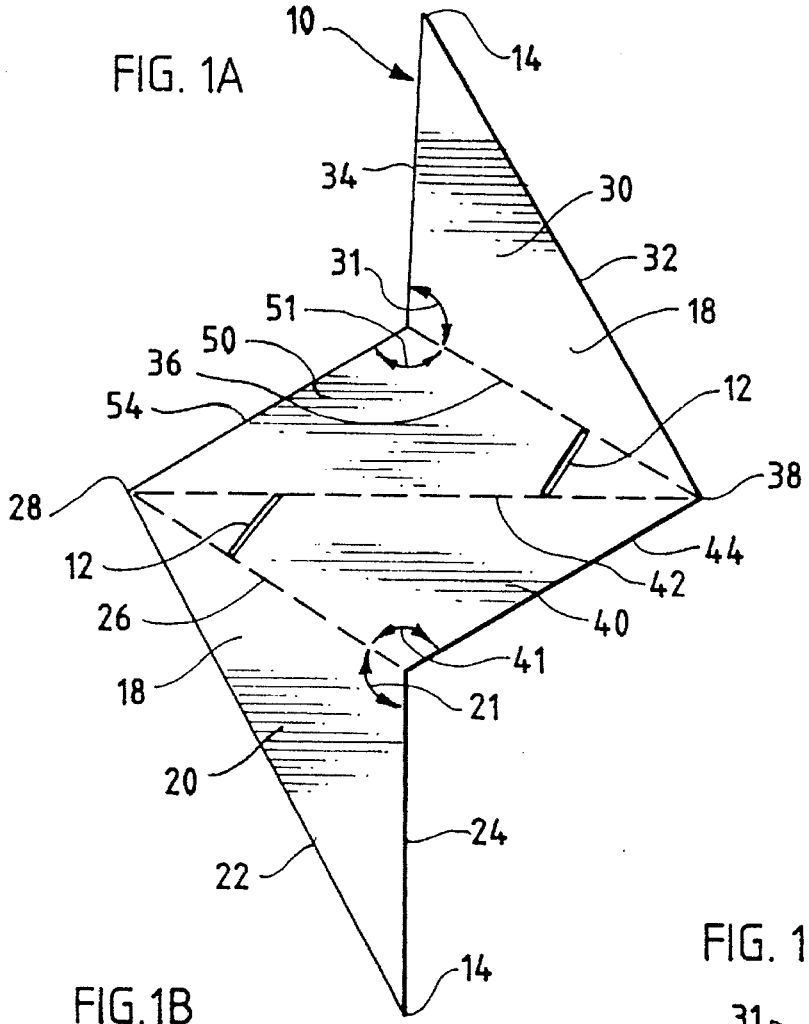
FIGS. 1A–1F are top perspective views of various possible construction blanks using different isosceles triangles.

Reference is made to FIG. 1A of the drawings which shows a first embodiment of one of the blanks using four isosceles triangular sections of generally the same shape and size. A blank 10 is made of a planar sheet of a semi-rigid material. The blank 10 is generally six sided and is divided into four triangular sections by three score lines 26, 36, and 42 along which the sheet is bendable. The triangular sections include two outer triangular sections 20 and 30, and two inner triangular sections 40 and 50. Inner triangular section 40 has a first side formed on a score line 26 that is in common with outer triangular section 20, a second side formed on a score line 42 that is in common with the other inner triangular section 50, and a third side on peripheral edge 44 of blank 10. Inner triangular section 50 has a first side formed on a score line 36 that is in common with outer triangular section 30, a second side formed on a score line 42 that is in common with the other inner triangular section 40, and a third side on peripheral edge 54 of blank 10. Outer triangular section 20 has two sides on peripheral edges 22 and 24 of blank 10 and a third side formed on a score line 26 that is in common with inner triangular section 40. Outer triangular section 30 has two sides on peripheral edges 32 and 34 of blank 10 and a third side formed on a score line 36 that is in common with inner triangular section 50. Edges 22 and 32, and crease 42 are generally of the same length. The length of edges 24, 34, 44, and 54, and creases 26 and 36 are all generally the same. Angles 21, 31, 41, and 51 are all generally of the same angle. Each section includes a plurality of vertices. Vertex 28 forms a common vertex of three triangular sections 20, 40, and 50. Vertex 38 forms a common vertex of three triangular sections 30, 40, and 50. Each outer triangular section 20 and 30 includes a tab connector 14. Tabs 14 are formed from the free vertices of triangular sections 20 and 30. Each inner triangular section 40 and 50 includes a slot connector 12. Slots 12 are formed by cutting through the thickness of blank 10 between creases 26 and 42, and between creases 36 and 42. Slot 12 of triangular section 40 is substantially parallel to edge 44. One end the slot is located at a distance from vertex 28 approximately one-third of the length of crease 26, and the other end the slot is located at a distance from vertex 28 approximately one-third of the length of crease 42. Slot 12 of triangular section 50 is sized and located in a similar manner. Tabs 14 and slots 12 are mateable connectors. A plurality of construction blanks 10 are connectable together for constructing solid polyhedrons.

An image 18 can be depicted on the surface of blank 10 as illustrated in FIG. 1A. Only those areas that will form the exposed exterior surface of the resulting polyhedron are shaded in FIG. 1A.

There are an unlimited number of possible configurations for blanks. These configurations are formed from different types of triangles. Six different possible configurations are illustrated in FIGS. 1A to 1F. Each figure is different as a result of a change of the size of angles 21, 31, 41, and 51. While only six examples are illustrated in the figures, an unlimited variety of configurations can be produced by changing the size of the angle. The size of the angle effects the height of the triangular pyramid that is formed when three blanks are joined in a manner similar to that depicted in FIG. 3A–3E.

Figure 1B:
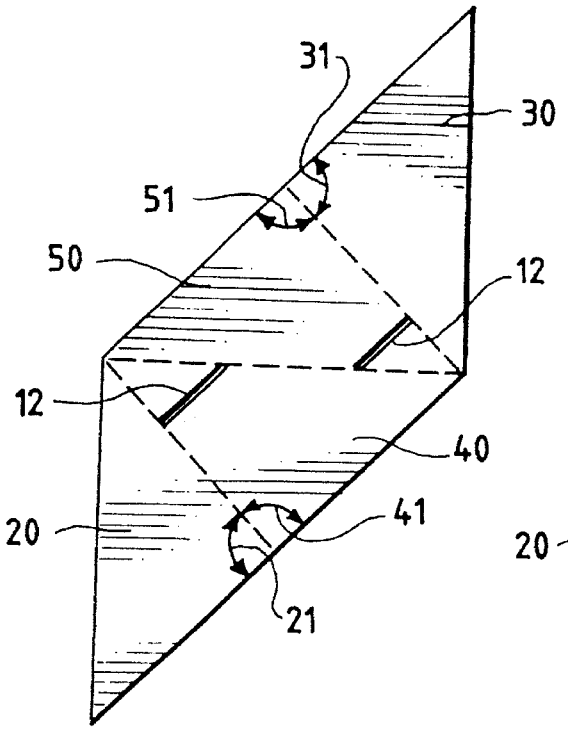
Figure 1C:
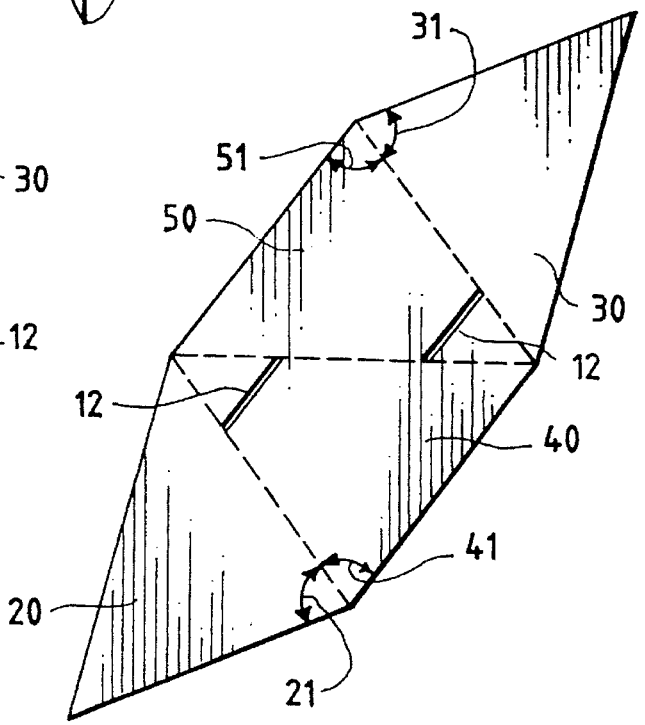
Figure 1D:
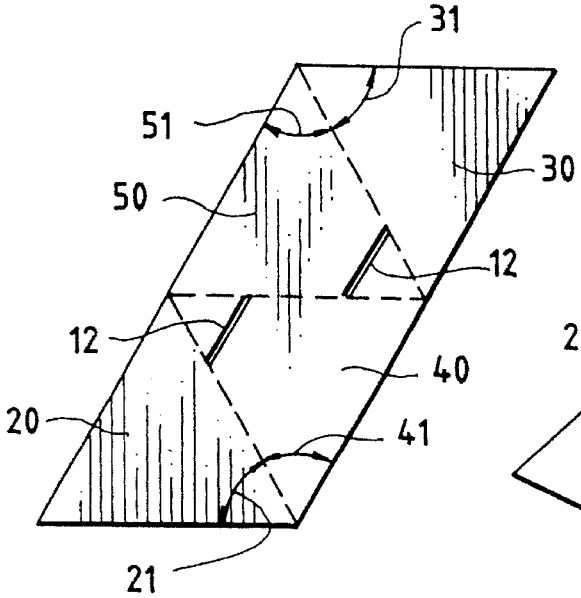
Figure 1E:
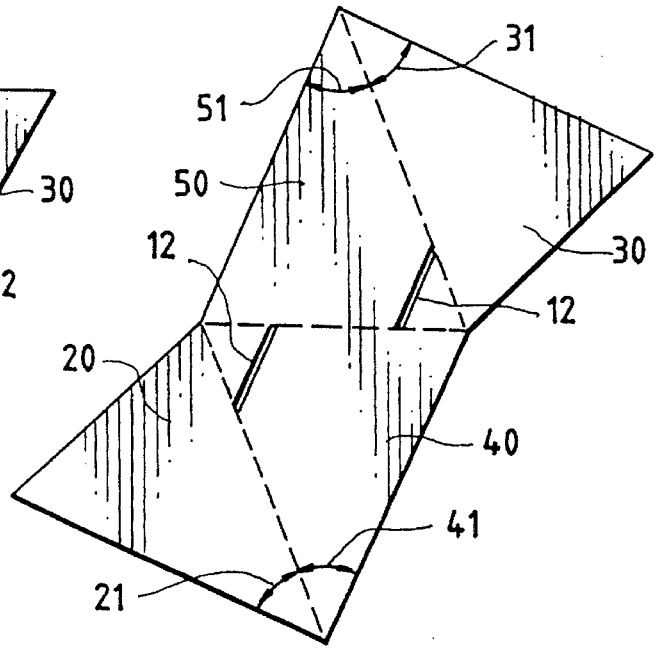
Figure 1F:
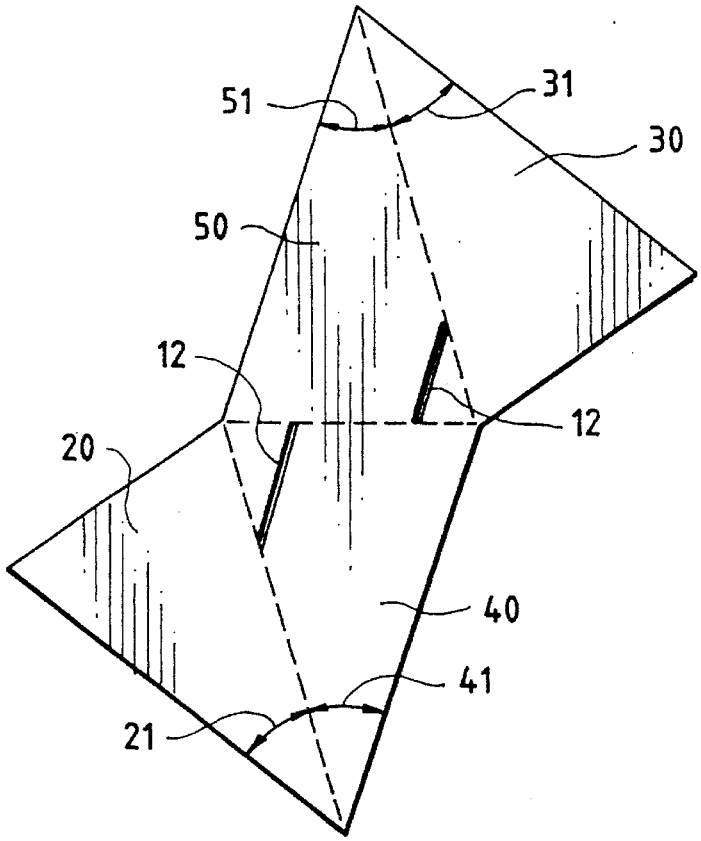

FIG. 1A illustrates a configuration at one extreme of the possible useful range of configurations. FIG. 1A is designed with each of the four angles 21, 31, 41, and 51 equal to 120 degrees. When three blanks are joined in a manner similar to that depicted in FIG. 3A–3E, a flat planar tiling is achieved. Configurations using angles greater than 120 degrees will not close to form a consistent solid. FIG. 1B is a blank formed from right isosceles triangles. FIG. 1B differs from FIG. 1A in that angles 21, 31, 41, and 51 of FIG. 1B are equal to 90 degrees. FIG. 1C is a blank in which angles 21, 31, 41, and 51 are all equal to 72 degrees. FIG. 1D, a blank formed from equilateral triangles, can be used to form the classic triangular based polyhedra such as the tetrahedron, octahedron, and icosahedron. FIG. 1D is designed with angles 21, 31, 41, and 51 equal to 60 degrees. FIG. 1E is designed by setting angles 21, 31, 41, and 51 equal to 45 degrees. FIG. 1F, a blank with angles 21, 31, 41, and 51 set at 36 degrees, can be used to form stellated polyhedra such as the small stellated dodecahedron and the great stellated dodecahedron.

Figure 2A:
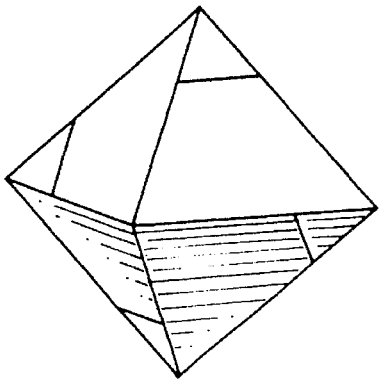
FIGS. 2A–2D are perspective views of four possible polyhedrons formed from the blanks depicted in FIGS. 1A–1F.
Figure 2B:
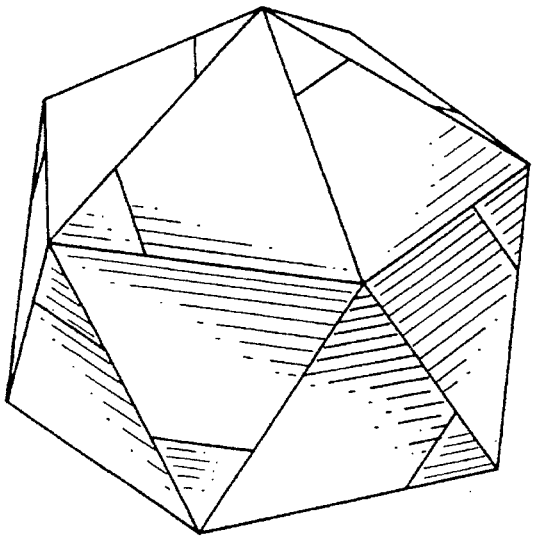
Figure 2C:
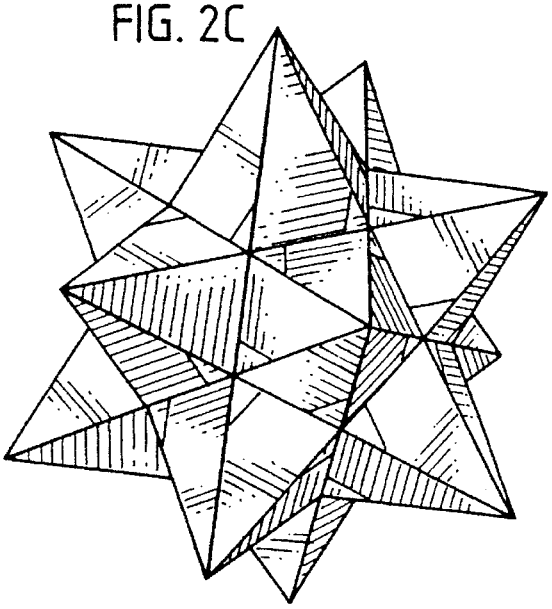
Figure 2D:
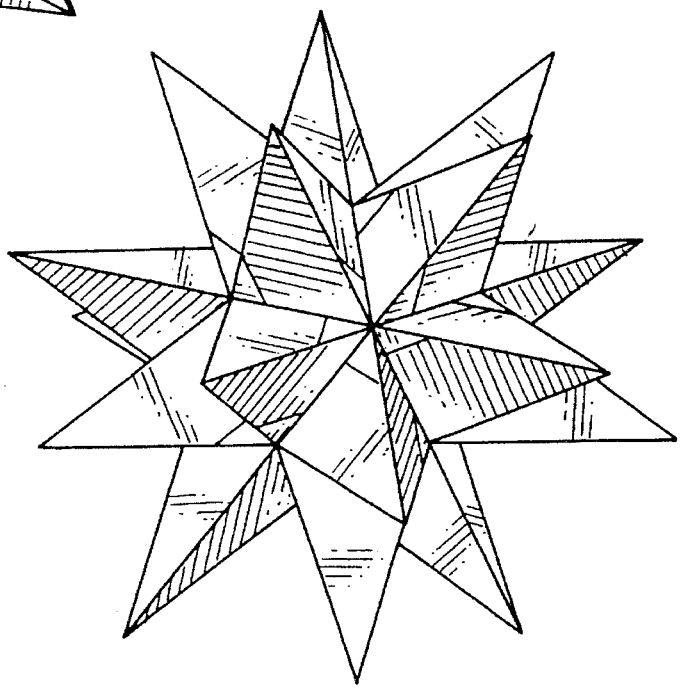

FIGS. 2A–2D show four different constructed polyhedra using the invention. FIG. 2A is a perspective view of an octahedron, a polyhedron that can be constructed from four blanks of the type illustrated in FIG. 1D. FIG. 2B is a perspective view of an icosahedron, a polyhedron that can be constructed from ten blanks of the type illustrated in FIG. 1D. FIG. 2C is a perspective view of a small stellated dodecahedron, a polyhedron that can be constructed from 30 blanks of the type illustrated in FIG. 1F. FIG. 2D is a perspective view of a great stellated dodecahedron, another polyhedron that can be constructed from 30 blanks of the type illustrated in FIG. 1F.

Figure 3A:
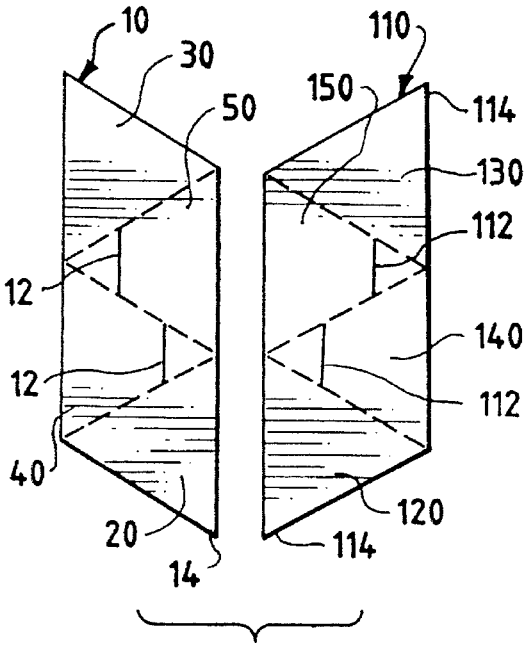
FIGS. 3A–3E are perspective views of the blanks of FIG. 1D illustrating the construction sequence used to form a tetrahedron.
Figure 3B:
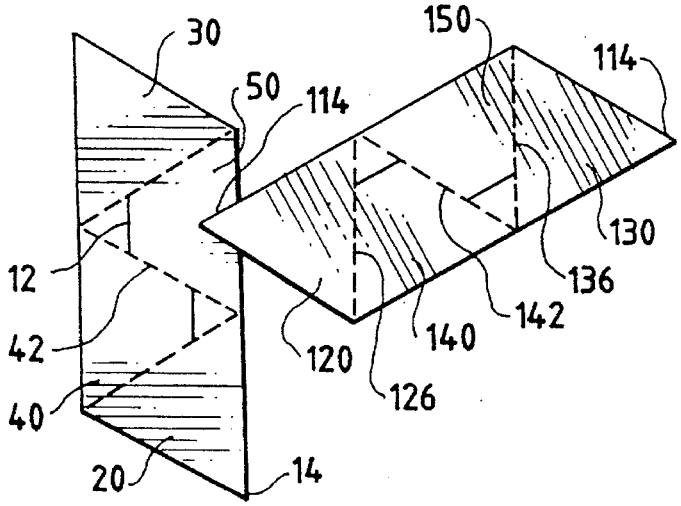
Figure 3C:
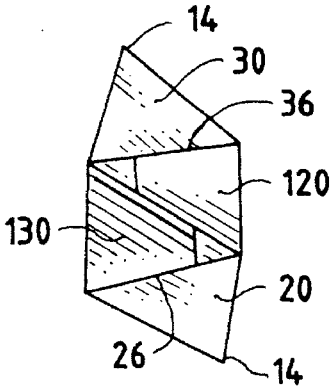
Figure 3D:
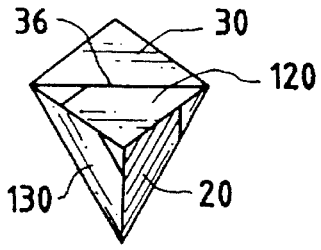
Figure 3E:
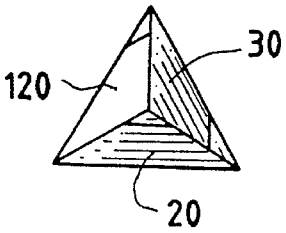

FIGS. 3A–3E show the construction sequence using two of the blanks illustrated in FIG. 1D to form a tetrahedron. For ease of reference, the first blank 10 is numbered consistent with FIG. 1A, and the second blank 110 is similarly numbered in the one hundreds. For example, parts 20 and 30 of the first blank are numbered 120 and 130 respectively on the second blank. As seen in FIG. 3A, blank 110 is flipped over so that it forms a mirror image of blank 10. Referring to FIG. 3B, blank 110 is rotated allowing tab 114 of triangular section 120 to be inserted into slot 12 of triangular section 50. Blank 110 is folded along crease 126 away from the viewer. Crease 42 is bent away from the viewer. Creases 142 and 136 are bent, wrapping blank 110 around blank 10. Referring to FIG. 3C, tab 114 of triangular section 130 is inserted into slot 12 of triangular section 40. Crease 26 is bent allowing tab 14 of triangular section 20 to be inserted into slot 112 of triangular section 140. Referring to FIG. 3D, crease 36 is bent allowing tab 14 of triangular section 30 to be inserted into slot 112 of triangular section 150. The completed tetrahedron is illustrated in FIG. 3E.

Figure 4A:
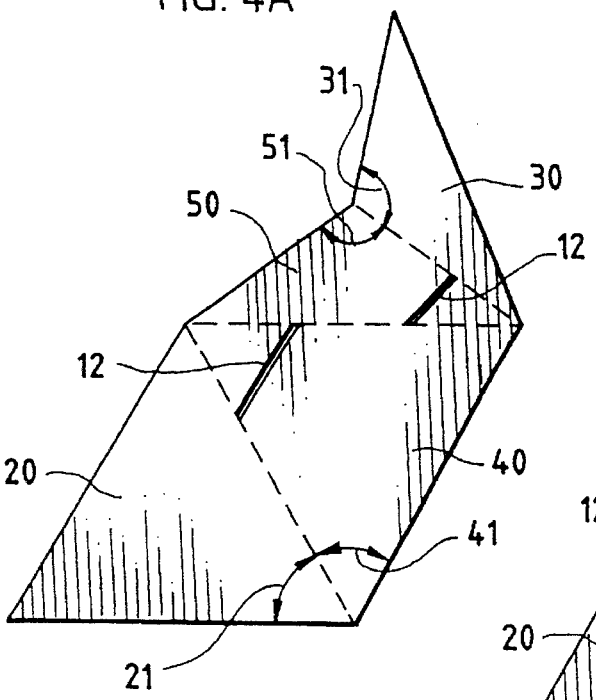
FIGS. 4A and 4B are top perspective views of another embodiment of the construction blanks of the present invention using dissimilar pairs of triangles.
Figure 4B:
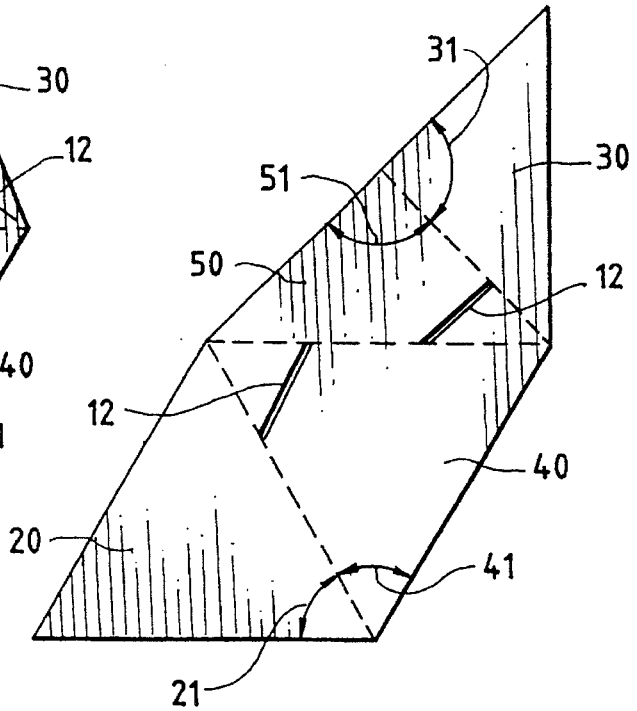
Figure 5A:
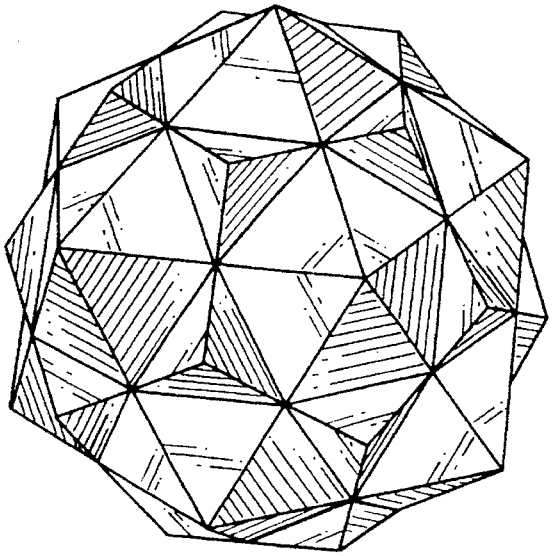
FIGS. 5A and 5B are perspective views of two possible polyhedrons formed from the blanks depicted in FIGS. 4A and 4B.
Figure 5B:
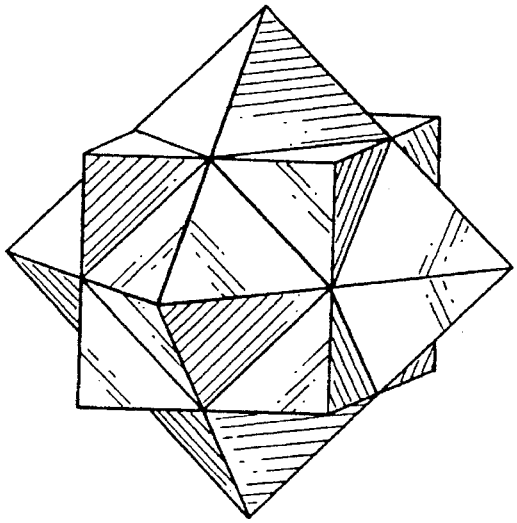
Figure 6A:
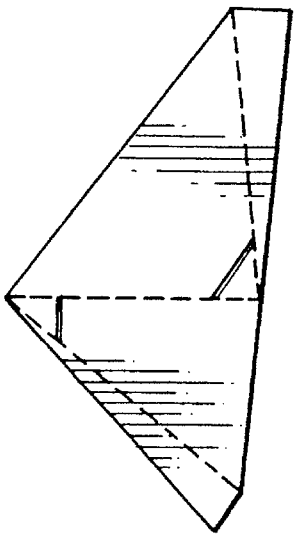
FIGS. 6A–6F are top perspective views of six different possible blanks each using differently sized and shaped triangles.
Figure 6B:
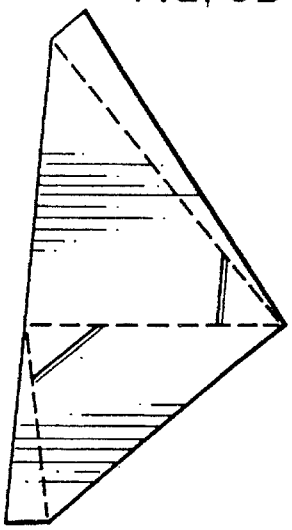
Figure 6C:
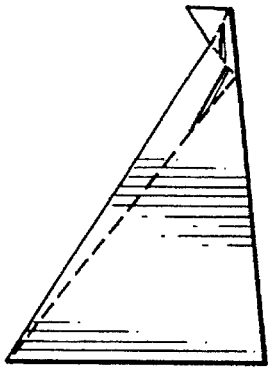
Figure 6D:
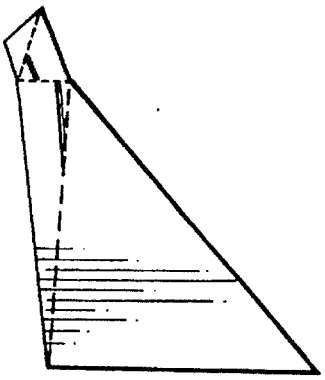
Figure 6E:
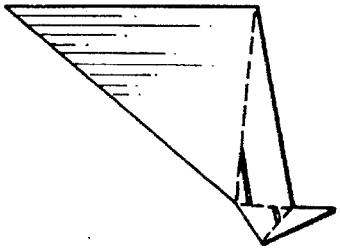
Figure 6F:
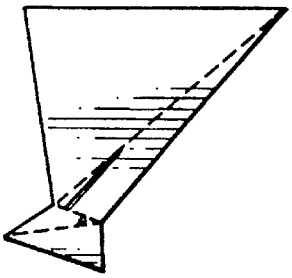

Blanks can be formed in which the four triangular sections in a given blank are not all generally similar. Combinations of different isosceles triangles within the same blank are illustrated in FIGS. 4A and 4B. FIG. 4A is a blank using two equilateral triangles and two obtuse isosceles triangles having an obtuse angle of 108 degrees. Sixty blanks of the type illustrated in FIG. 4A can be combined to form a polyhedron which is illustrated in FIG. 5A known as a Dodecahedron-plus-Icosahedron. FIG. 4B is another possible blank using two right isosceles triangles and two equilateral triangles. Twenty-four blanks of the type illustrated in FIG. 4B can be combined to form a polyhedron which is illustrated in FIG. 5B known as a Cube-plus-Octahedron.

Figure 7:
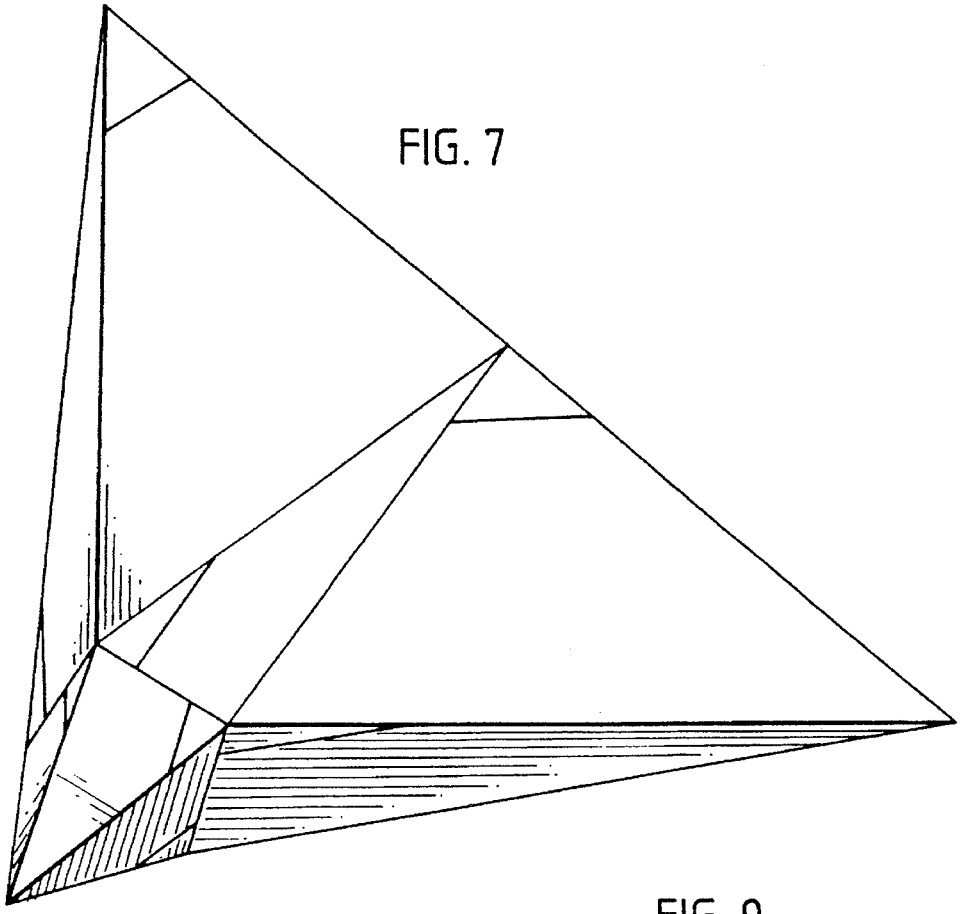
FIG. 7 is a perspective view of a jet aircraft formed using each blank of FIG. 6A–6F.

FIGS. 6A–6F show six blanks in which all triangular sections in a given blank are different. The blanks in FIGS. 6A–6F have been designed to allow construction of a specific shape that resembles a jet aircraft. FIG. 7 is a perspective view of a fully constructed polyhedron according to the invention using the six blanks from FIG. 6A–6F. The resulting polyhedron illustrated in FIG. 7 resembles a jet aircraft. This figure demonstrates the flexibility of the construction system to form a large variety of uniquely shaped polyhedra.

Figure 8:
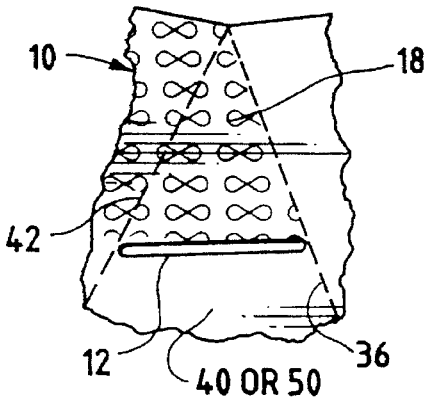
FIG. 8 is a partial top view of a blank illustrating a slot connector.
Figure 9:
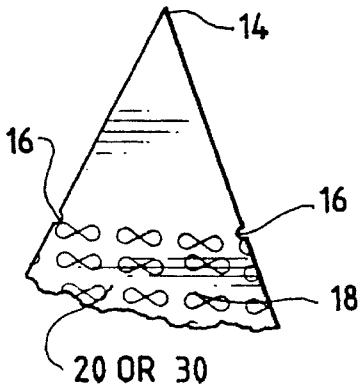
FIG. 9 is a partial top view of a blank illustrating a tab connector that mates with the slot connector of FIG. 8.
Figure 10:
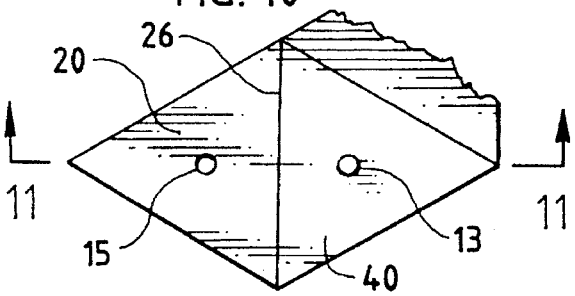
FIG. 10 is a partial top view of a blank illustrating a peg and hole connector.
Figure 11:
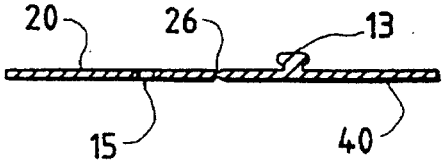
FIG. 11 is a cross sectional view of FIG. 10 illustrating a peg and hole connector.

FIG. 8 shows the preferred embodiment of a slot connector. Slot 12 is formed by cutting through the thickness of triangular section 50 of blank 10 between creases 36 and 42. Slot 12 may extend completely across the width of the triangular section, or as illustrated in FIG. 8, may be substantially equal to but slightly less than the width of the triangular section. FIG. 9 shows the preferred embodiment of a tab connector. Tab 14 is an integral part of outer triangular section 20 or 30. FIG. 9 shows a notch 16 on each edge of triangular section 20 or 30 at a location that corresponds to the location of the slot on triangular section 40 or 50. The width of tab 14 at the location of notch 16 is equal to the width of slot 12. When the tab is inserted into the slot, a slight snapping action occurs due to the interference fit between slot and tab. FIG. 10 shows an alternate connecting mechanism formed of a protrusion, referred to as a peg 13, extending outwardly from the face of triangular section 40, and a mateable connector formed from a hole 15 extending through the thickness of triangular section 20. The top of peg 13 is slightly larger than the bottom of the peg and is slightly larger than the diameter of hole 15 providing an interference fit as peg 13 is inserted into hole 15. Also the diameter of hole 15 is slightly larger than the diameter of the bottom of peg 13 so that the peg interlocks smoothly once the interference fit at the top of the peg is cleared. FIG. 11 is a cross sectional view of FIG. 10 illustrating peg 13 as a protrusion extending from the face of triangular section 40 and hole 15 extending through the thickness of triangular section 20.

SUMMARY, RAMIFICATION, AND SCOPE

Accordingly, the reader will see that a new and improved blank for constructing triangular polyhedra has been provided. The blank is simple in design allowing a large variety of shapes to be manufacturable at low cost. Blanks can be manufactured from construction paper or cardboard allowing the use of image bearing surfaces. The use of facially overlapping surfaces provides structural stability of the resulting polyhedra. The blanks can be repeatedly assembled, disassembled, and reassembled into a plurality of shapes, limited only by the imagination of the user.

Although the description above contains many specificities, these should not be construed as limiting the scope of the invention but as merely providing illustrations of some of the presently preferred embodiments of this invention. For example, the method of interconnection can take other forms such as multiple slots or adhesives. The location and dimensions of the connectors can be altered. Different images can be printed on the surface of the blanks so that the resulting polyhedron forms a distinct surface pattern requiring a specific construction sequence. Thus a three dimensional puzzle can formed from the invention. The size and thickness of the blank can be altered to allow easier manipulation by younger children. The image of blanks can be printed on a larger sheet and assembled into booklet form allowing the user to cut the blanks by hand.

Thus, it is to be understood that, within the scope of the appended claims, the invention may be practiced otherwise than as described hereinabove.

What is claimed and desired to be secured by Letters Patent is:

1. A construction blank, a plurality of which are connectable together for constructing solid polyhedrons comprising: a planar sheet of a semi-rigid material, said sheet being divided into four triangular sections by three score lines along which said sheet is bendable, said triangular sections including two outer triangular sections and two inner triangular sections and each section including a plurality of vertices, each of said inner triangular sections having a first side formed on a score line in common with an outer triangular section, a second side formed on a score line in common with the other inner triangular section and a third side on a peripheral edge of said blank, each of said outer triangular sections having two sides on respective peripheral edges of said blank and each of said outer triangular sections including a first connector and each of said inner triangular sections including a second connector contained within said inner triangular section, said first connectors being of a type mateable with said second connectors.

2. A construction blank as recited in claim 1 wherein each of said four triangular sections are isosceles triangles.

3. A construction blank as recited in claim 2 wherein said isosceles triangles have the same shape.

4. A construction blank as recited in claim 2 wherein two of said isosceles triangles have the same first shape and two of said isosceles triangles have the same second shape, said first shape being different from said second shape.

5. A construction blank as recited in claim 2 wherein one of said outer triangular sections and its adjacent inner triangular section have the same shape which is different from the shape of the other outer triangular section and its adjacent inner triangular section.

6. A construction blank as recited in claim 1 wherein each of said outer triangular sections includes a free vertex that is not in common with an inner triangular section and each of said first connectors includes a tab section formed on a portion of the outer triangular section that includes said free vertex; and each of said second connectors includes a slot formed in said inner triangular sections.

7. A construction blank as recited in claim 1 wherein said first connectors are formed of a protrusion extending outwardly from a face of said triangular sections and said second connectors are formed of holes extending through said triangular sections.

8. A construction blank as recited in claim 1 wherein said second connectors are formed of a protrusion extending outwardly from a face of said triangular sections and said first connectors are formed of holes extending through said triangular sections.

9. A construction blank as recited in claim 1 wherein each of said triangular sections has a different triangular shape.

10. A construction blank, a plurality of which are connectable together for constructing solid polyhedrons comprising: a planar sheet divided into four contiguous triangular sections by three score lines along which said sheet is bendable, said triangular sections including two outer triangular sections and two inner triangular section, each inner triangular section including a plurality of vertices wherein each of two of said vertices forms a common vertex of three of said triangular sections, and each of said outer triangular sections including a first connector and each of said inner triangular sections including a second connector contained within said inner triangular section, said first connectors being of a type mateable with said second connectors.

11. A construction blank as recited in claim 10 wherein each of said four triangular sections are isosceles triangles.

12. A construction blank as recited in claim 11 wherein said isosceles triangles have the same shape.

13. A construction blank as recited in claim 11 wherein two of said isosceles triangular sections have the same first shape and two of said isosceles triangular sections have the same second shape, said first shape being different from said second shape.

14. A construction blank as recited in claim 11 wherein one of said outer triangular sections and its adjacent inner triangular section have the same shape which is different from the shape of the other outer triangular section and its adjacent inner triangular section.

15. A construction blank as recited in claim 10 wherein each of said outer triangular sections includes a free vertex that is not in common with an inner triangular section and each of said first connectors includes a tab section formed on a portion of the outer triangular section that includes said free vertex; and each of said second connectors includes a slot formed in said inner triangular sections.

16. A construction blank as recited in claim 10 wherein said first connectors are formed of a protrusion extending outwardly from a face of said triangular sections and said second connectors are formed of holes extending through said triangular sections.

17. A construction blank as recited in claim 10 wherein said second connectors are formed of a protrusion extending outwardly from a face of said triangular sections and said first connectors are formed of holes extending through said triangular sections.

18. A construction blank as recited in claim 10 wherein each of said triangular sections has a different triangular shape.

19. A construction set of a plurality of blanks connectable together for constructing solid polyhedrons, each of said blanks comprising: a planar sheet of a semi-rigid material said sheet being divided into four triangular sections by three score lines along which said sheet is bendable, said triangular sections including two outer triangular sections and two inner triangular sections and each section including a plurality of vertices, each of said inner triangular sections having a first side formed on a score line in common with an outer triangular section, a second side formed on a score line common with the other inner triangular section and a third side on a peripheral edge of said blank, each of said outer triangular sections having two sides on respective peripheral edges of said blank and each of said outer triangular sections including a first connector and each of said inner triangular sections including a second connector contained within said inner triangular section, said first connectors being of a type mateable with said second connectors.

20. A construction set as recited in claim 19 wherein each of said triangular section is an isosceles triangle and two or more of said sections have the same shape.

21. A construction set as recited in claim 19 wherein none of the triangular sections on a blank have the same triangular shape and wherein the outer triangular section on one blank of said set has the same triangular shape as an inner triangular section of a second blank.

* * * * *